US005944353A

United States Patent [19]

Sato

[11] Patent Number: 5,944,353

[45] Date of Patent: Aug. 31, 1999

[54] DOCUMENT COVER

[76] Inventor: Hisao Sato, Fujimidai Mansion 2002, 29-10, Nukui 1-chome, Nerima-ku, Tokyo, Japan

[21] Appl. No.: 09/123,362

[22] Filed: Jul. 28, 1998

[51] Int. Cl.[6] ..... B42F 3/04; B42F 9/00; B42D 3/06

[52] U.S. Cl. ..... 281/29; 281/36; 281/46; 281/15.1; 281/21.1; 281/35; 281/45

[58] Field of Search ..... 281/36, 46, 29, 281/15.1, 21.1, 35, 45

[56] References Cited

U.S. PATENT DOCUMENTS 5,433,481 7/1995 Corbishley ..... 281/45

*Primary Examiner*—Willmon Fridie, Jr.
*Assistant Examiner*—Mark T. Henderson
*Attorney, Agent, or Firm*—Kaensaka & Takeuchi

[57] ABSTRACT

A document cover formed of a thin sheet material of synthetic resin, includes a front cover portion, a rear cover portion, and a fold portion formed in a boundary portion between the front cover portion and the rear cover portion. The fold portion includes a plurality of fold lines formed at intervals, whereby the cover can be folded easily in the vicinity where documents are bound, and after the front portion of the cover is once opened, the opened state of the cover can be held as it is.

6 Claims, 9 Drawing Sheets

DOCUMENT COVER

BACKGROUND OF THE INVENTION

The present invention relates to a document cover for protecting documents.

For custody/delivery of documents such as data, drawings, etc., the documents are sometimes covered with a document cover so as to be protected. Examples of a material for such a document cover include more or less thick woodfree paper, straw board, synthetic resin sheet material, composite paper, etc. In the case where the documents are covered with woodfree paper or straw board, the cover serving as a front cover can be folded easily by hand but it is difficult to form a straight fold line accurately. Accordingly, there has been provided a cover in which a guide depression line is formed in advance by means of pressure molding, or the like, in the portion where the fold line is to be formed.

However, such a paper cover per se is not suitable to carry because it has a disadvantage that it is susceptible to friction, low in durability and easy to get wet. When the document cover is formed of straw board, there is a disadvantage as follows. That is, the hold of the cover folded by hand cannot be released because the folded cover may be unfolded if the hold is released even in the case where a fold line is formed in advance in the cover so that the cover can be folded easily. On the other hand, a cover made of a synthetic resin sheet material or composite paper is suitable to carry not only because the synthetic resin sheet material or composite paper is incomparably higher both in abrasion resistance and in durability than paper but also because the synthetic resin sheet material or composite paper is water-resistant.

The synthetic resin sheet material is, however, greatly firm as compared with paper, so that the synthetic resin sheet material folded by hand may be unfolded soon even if the hold of the folded material is released. Therefore, fold lines are provided in a boundary portion between a front cover portion and a rear cover portion, and they are used to open the cover with documents fixed on the rear cover portion. Such a cover has no problem in binding thin documents but has a disadvantage that the front cover portion rises up when the documents are thick. This is because, in this case, a back portion having a width corresponding to the thickness of the documents is required to be provided in a boundary portion between the front and rear cover portions of the cover, but there is no fold line in a boundary portion between the front cover portion and the back portion.

SUMMARY OF THE INVENTION

The present invention is designed to solve the problems in use in the prior art.

A first object of the present invention is to provide a document cover which is formed of synthetic resin sheet material so that the cover can be folded easily in the vicinity of a document-binding portion and the folded state can be held even after a front cover portion of the cover is opened.

A second object of the present invention is to provide a document cover in which a front cover portion of the cover or a rear cover portion of the cover never rises up even in the case where documents are thick.

A third object of the present invention is to provide a document cover which can be attached easily to a binder, a loose-leaf binder, etc.

In order to achieve the above first and second objects, according to an aspect of the present invention, provided is a document cover formed of a thin sheet material of synthetic resin, comprising a front cover portion, a rear cover portion, and a fold portion formed in a boundary portion between the front cover portion and the rear cover portion, the fold portion including a plurality of fold lines formed at intervals.

In order to achieve the above first and second objects, in the above document cover, preferably, the plurality of fold lines in the fold portion include peak fold lines and trough fold lines formed alternately.

In order to achieve the above first and second objects, in the above document cover, preferably, an end edge portion of the front cover portion opposite to the fold portion is folded inside to thereby form a cover flap portion.

In order to achieve the above first and second objects, in the above document cover, preferably, end edge portions of the front and rear cover portions opposite to the fold portion are folded inside to thereby form cover flap portions respectively.

In order to achieve the above third object, in the above document cover, preferably, the fold portion includes a flat portion located in its center portion so that the plurality of fold lines include a group of fold lines formed in a boundary portion between the flat portion and the front cover portion, another group of fold lines formed in a boundary portion between the flat portion and the rear cover portion, and a center fold line formed in a center portion of the flat portion, and holes in which document stopper members of a binder or loose-leaf binder are to be inserted are formed in the flat portion so that the holes formed in one part of the flat portion on the front cover portion side coincide with the holes formed in the other part of the flat portion on the rear cover portion side when the document cover is folded at the center fold line whereby the front cover portion and the rear cover portion come face to face each other and the one and the other parts of the flat portion come face to face each other.

In order to achieve the above third object, in the above document cover, preferably, clip holes in which clips for clipping outer surfaces of the front and rear cover portions are to be inserted are further formed so that the clip holes formed in the one part of the flat portion coincide with the clip holes formed in the other part of the flat portion when the document cover is folded at the center fold line whereby the one and the other parts of the flat portion come face to face each other.

DESCRIPTION OF THE PREFERRED EMBODIMENTS

Figure 1:
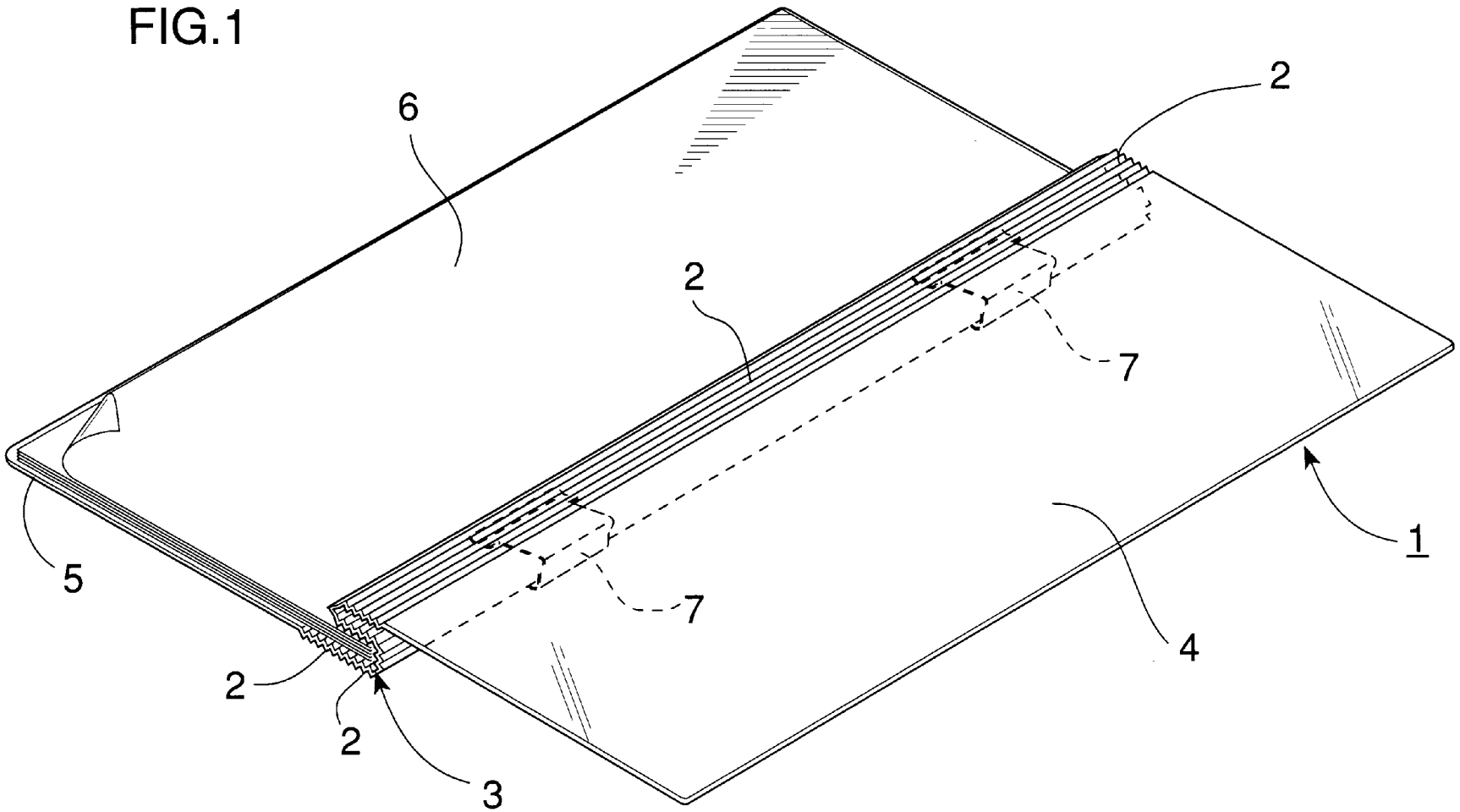
FIG. 1 is a perspective view of a document cover according to a first embodiment of the present invention in a state in which a front cover portion of the document cover is opened.

Embodiments of the present invention will be described below with reference to the drawings. In the following embodiments, parts which can be regarded as being equivalent are referenced by the same reference numerals for the purpose of avoiding duplicated description about those parts.

Figure 2:
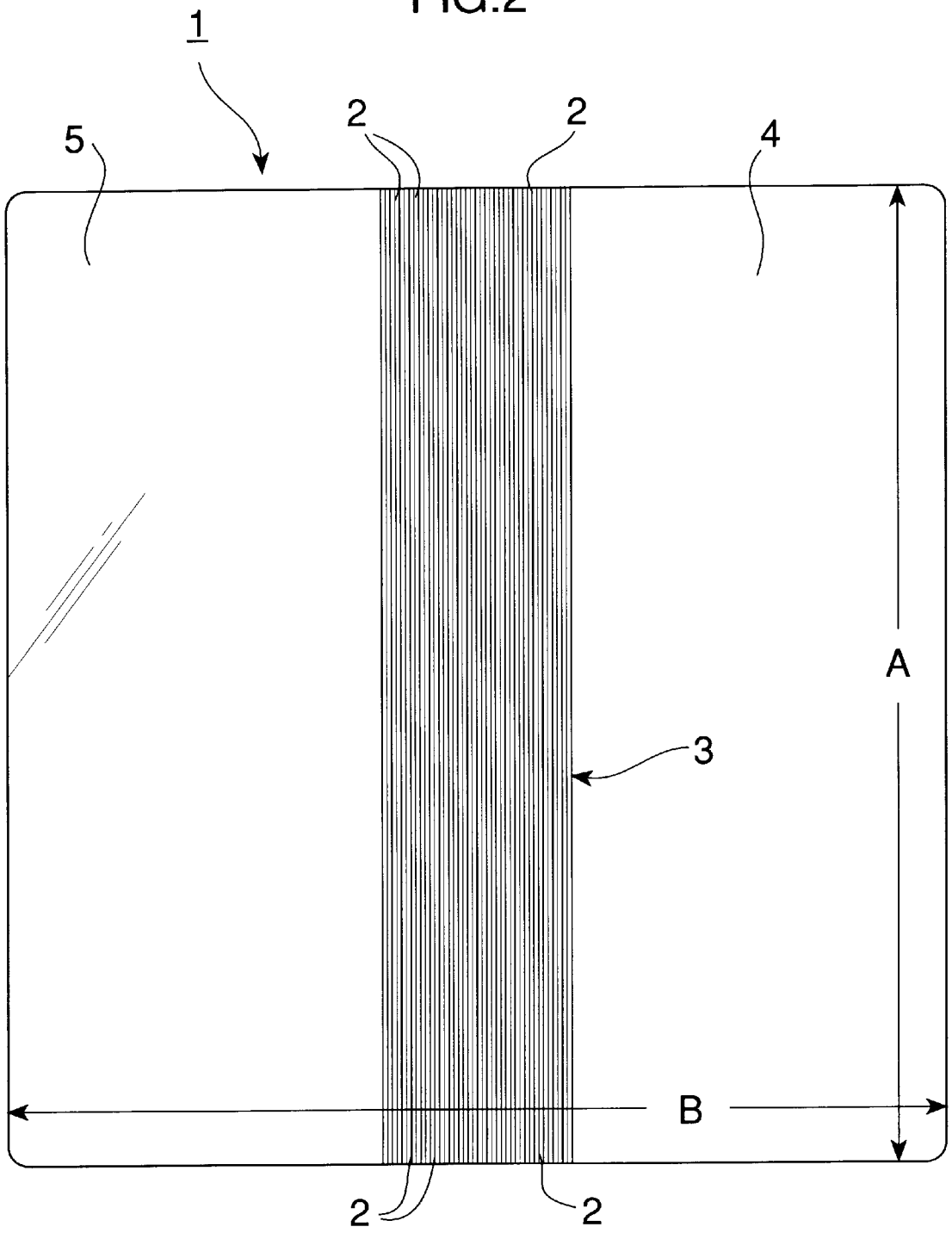
FIG. 2 is a plan view showing the first embodiment in a state in which the document cover is fully opened.
Figure 3:
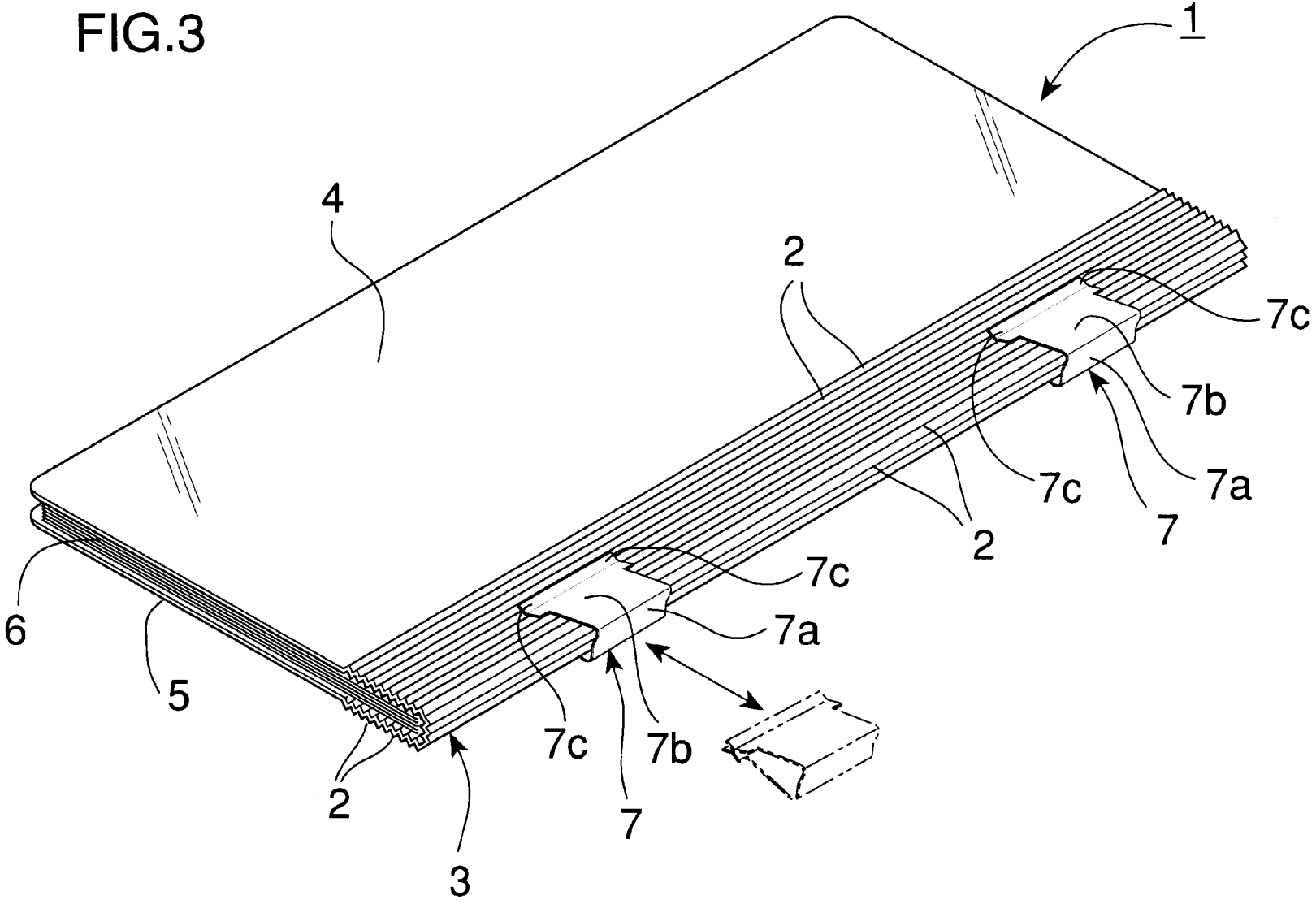
FIG. 3 is a perspective view of the document cover according to the first embodiment of the invention for explaining the case where documents are fastened by clips.

Referring now to FIGS. 1 through 3, a first embodiment of the present invention will be described.

As shown in FIG. 2, the document cover 1 is formed of a thin sheet member of synthetic resin such as polypropylene which is transparent or semitransparent, moderately firm, flexible and light. It is a matter of course that the synthetic resin is not limited to polypropylene, and any synthetic resin sheet member or any composite paper may be used so long as the material is light and firm to some degree and has a so-called hinge effect so that the material is foldable repeatedly. The size of the document cover 1 is set as follows. When, for example, the size of documents to be bound is A4-size, the length A of the document cover 1 in its longitudinal direction (vertical direction in the drawing) is set so as to be slightly longer than the longitudinal length of the A4-size so that the upper and/or lower portion of the documents is prevented from projecting out of the document cover. On the other hand, the length B of the document cover 1 in this transverse direction (horizontal direction in the drawings) is set so as to be longer, by a value corresponding to the thickness of the documents to be bound, than the value twice as long as the transverse length of the A4-size.

The document cover 1 has a fold portion 3 provided in the transverse center of the document cover 1. A plurality of fold lines 2 are formed longitudinally at regular intervals in the fold portion 3. One side of the fold portion 3 serves as a front cover portion 4, and the other side serves as a rear cover portion 5. The fold lines 2 are formed, for example, by means of hot-press so that peak fold lines and trough fold lines are formed alternately like an accordion. The fold portion 3 is formed such that the fold portion 3 is partially located both in the front cover portion 4 and in the rear cover portion 5 when documents are bound. Incidentally, the first embodiment shows the case where the right side of documents is bound as shown in FIG. 1. Accordingly, the right side of the document cover 1 in FIG. 2 is the front cover portion 4, and the left side of the same is the rear cover portion 5. If the left side of documents is to be bound, the document cover 1 will be used in the state where the up and down sides are inverted in FIG. 1.

The usage of the document cover 1 will be described below. As shown in FIG. 3, documents 6 to be bound are held in the document cover 1 folded into two. The document cover 1 is clipped by clips 7 from the fold portion 3 side so that the documents 6 are fixed in the document cover 1. Each of the clips 7 is formed of a belt-like elastic metal plate as disclosed in U.S. Pat. Nos. 4,353,157 and 4,996,755. Each of the clips 7 is formed such that a bent portion 7*a* is provided in the longitudinal center of the metal plate so as to have a thickness substantially equal to the maximum binding thickness, and the longitudinal opposite end portions of the metal plate are bent in the same direction at the bent portion 7*a* so as to provide a pair of abutment portions 7*b* which abut on each other elastically, a pair of lug portions 7*c* being provided in opposite end edges of each of the abutment portions 7*b* so as to extend perpendicularly to the longitudinal direction of the metal plate. Such clips 7 are loaded in a clip driver as disclosed in the aforementioned U.S. Patents and used as follows. While the abutment portions 7*b* are forcedly opened by means of the lug portions 7*c*, documents are put between the abutment portions 7*b*. Then, clips 7 are discharged one by one from the clip driver. As a result, the documents are firmly fastened by the clips 7. If each of the clips 7 is pulled out while the opposite end portions of the pair of the abutment portions 7*b* are nipped by fingers, the clips 7 can be removed from the documents.

To read the documents 6 bound in the document cover 1 by means of the clips 7, as shown in FIG. 1, the front cover portion 4 can be folded easily from a portion of a trough fold line 2 near the respective forward ends of the abutment portions 7*b* of the clips 7. Accordingly, even in the case where the hold of the front cover portion 4 by hand is released, the front cover portion 4 never returns to the closed state. To detach the documents 6 from the document cover 1, as represented by the dot line in FIG. 3, the clips 7 can be removed from the document cover 1 easily if the clips 7 are pulled out in the direction of the arrow while the opposite end portions of the pair of abutment portions 7*b* of each of the clips 7 are nipped by fingers. Accordingly, not only the document cover 1 but also the documents 6 are never injured when the clips 7 are removed. Further, the fold lines 2 are provided in a manner such that peak fold lines and trough fold lines are formed alternately like an accordion. Accordingly, even in the case where the documents 6 are thick, the front and rear cover portions 4 and 5 never rise up because a wide back portion may be formed over any two of the peak fold lines in the fold portion 3.

When the documents 6 are bound by the document cover 1 in the aforementioned manner, the documents 6 can be protected. Further, since the cover 1 is formed of a synthetic resin sheet material, the document cover 1 has high durability against both friction and water. Accordingly, the documents can be protected surely even in the case where the documents are carried in such a condition that the documents may be rubbed, or affected by rain, sweat, etc. Further, when the document cover 1 is made transparent or semitransparent, a title, or the like, need not be written on the front cover portion 4 of the document cover 1 because the surface or the first page of the documents can be seen through the document cover. Further, if the documents 6 are bound in the document covers 1 separately while classified by themes or sections, the documents can be arranged efficiently.

Figure 4:
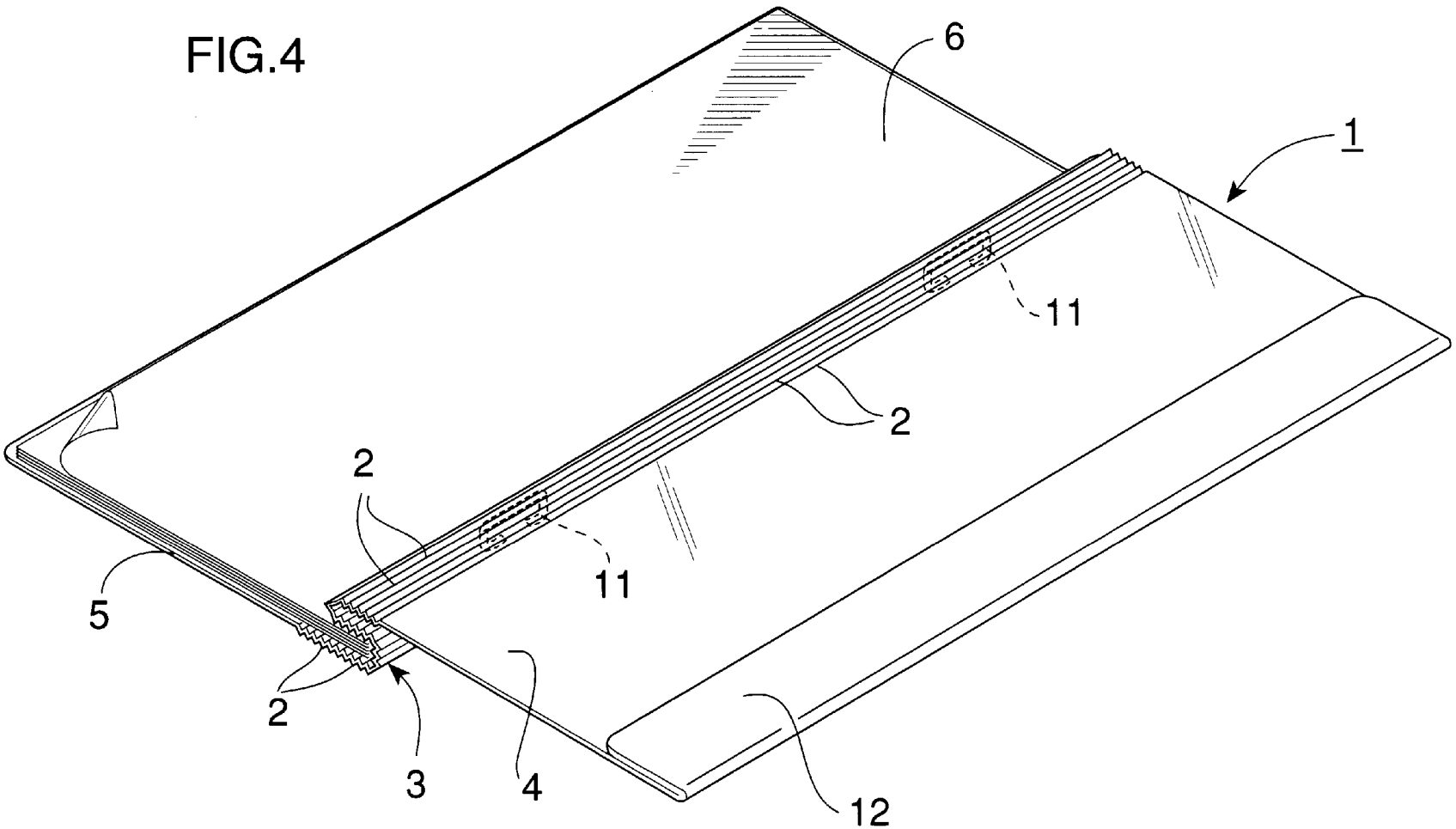
FIG. 4 is a perspective view of a document cover according to a second embodiment of the present invention in a state in which a front cover portion of the document cover is opened.
Figure 5:
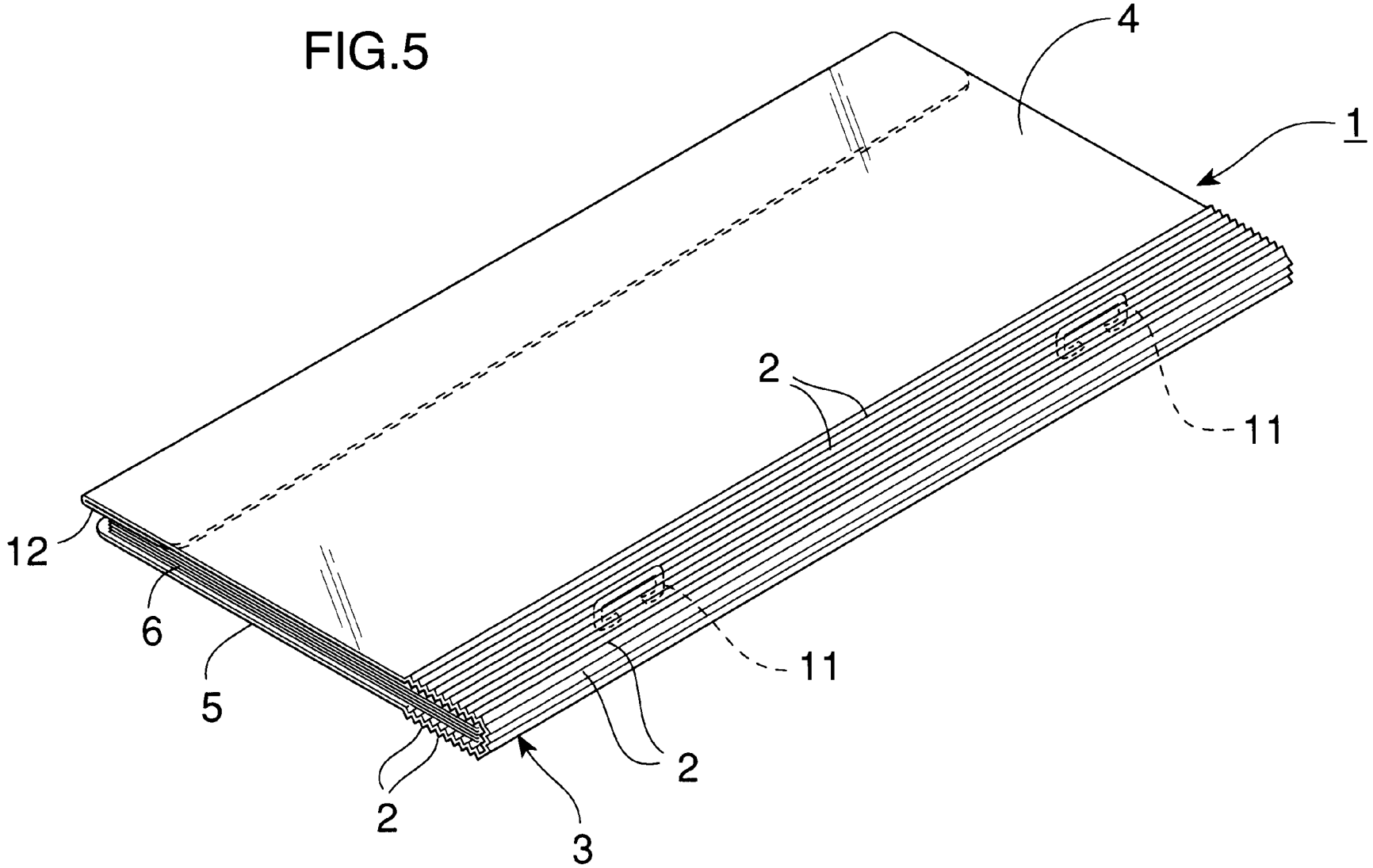
FIG. 5 is a perspective view of the document cover according to the second embodiment in a state in which documents are bound.

Although the first embodiment has shown the case where the documents 6 are bound in the document cover 1 by means of the clips 7, the documents may be fastened by means of staples in such a manner as shown in FIGS. 4 and 5 illustrating a second embodiment of the present invention.

Because the document cover 1 is formed of a thin sheet member as described above, staples 11 can pass through the document cover 1 easily. Accordingly, the documents can be fastened by means of the staples 11. Because the opposite end portions of each staple 11 are bent on the outside of the rear cover portion 5, the last page of the documents 6 is never injured by the opposite end portions of the staples 11.

In this case, the front cover portion 4 is opened at any one of the trough fold lines in the fold lines 2 near the staples 11.

Further, in the second embodiment, a cover flap portion 12 is provided in the front cover portion 4. That is, the front cover portion 4 is set to be longer than the rear cover portion 5. The surplus of the front cover portion 4 is folded inside to thereby form the cover flap portion 12. If the front surface or inside cover of the documents 6 is put between the front cover portion 4 and the cover flap portion 12, the front surface or inside cover of the documents 6 can be seen through the front cover portion 4. In this case, the text of the documents can be read immediately when the front cover portion 4 is opened. Accordingly, it is not necessary to write any title, or the like, on the front cover portion 4, because the classification of the documents can be recognized from the outside of the document cover. Although the second embodiment also has shown the case where the right side of the documents is bound, if the left side of the documents is to be bound, the document cover 1 is used in the state where the up and down sides are inverted, in the same manner as in the first embodiment.

Figure 6:
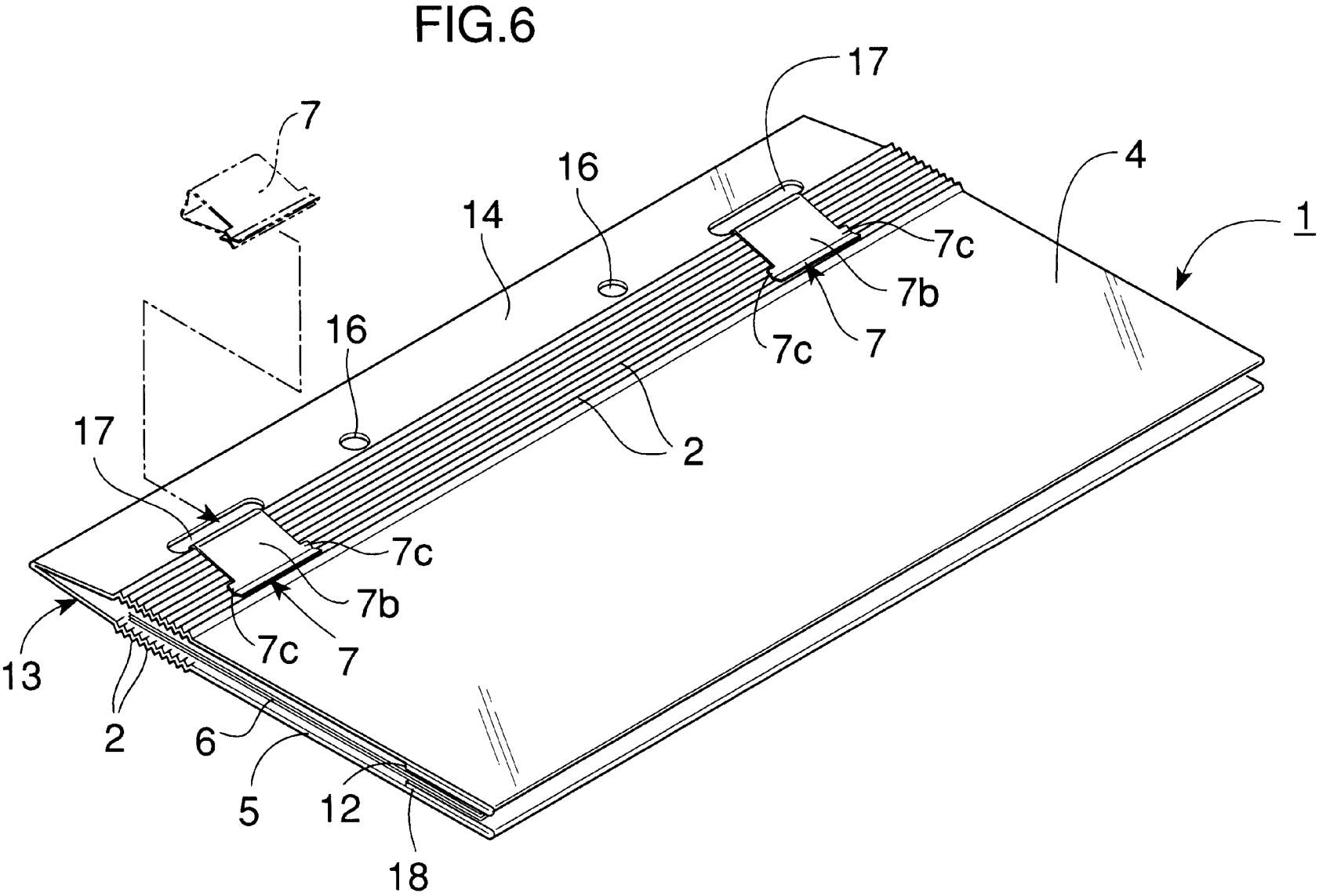
FIG. 6 is a perspective view of a document cover according to a third embodiment of the present invention for explaining the case where documents are fastened by clips.
Figure 7:
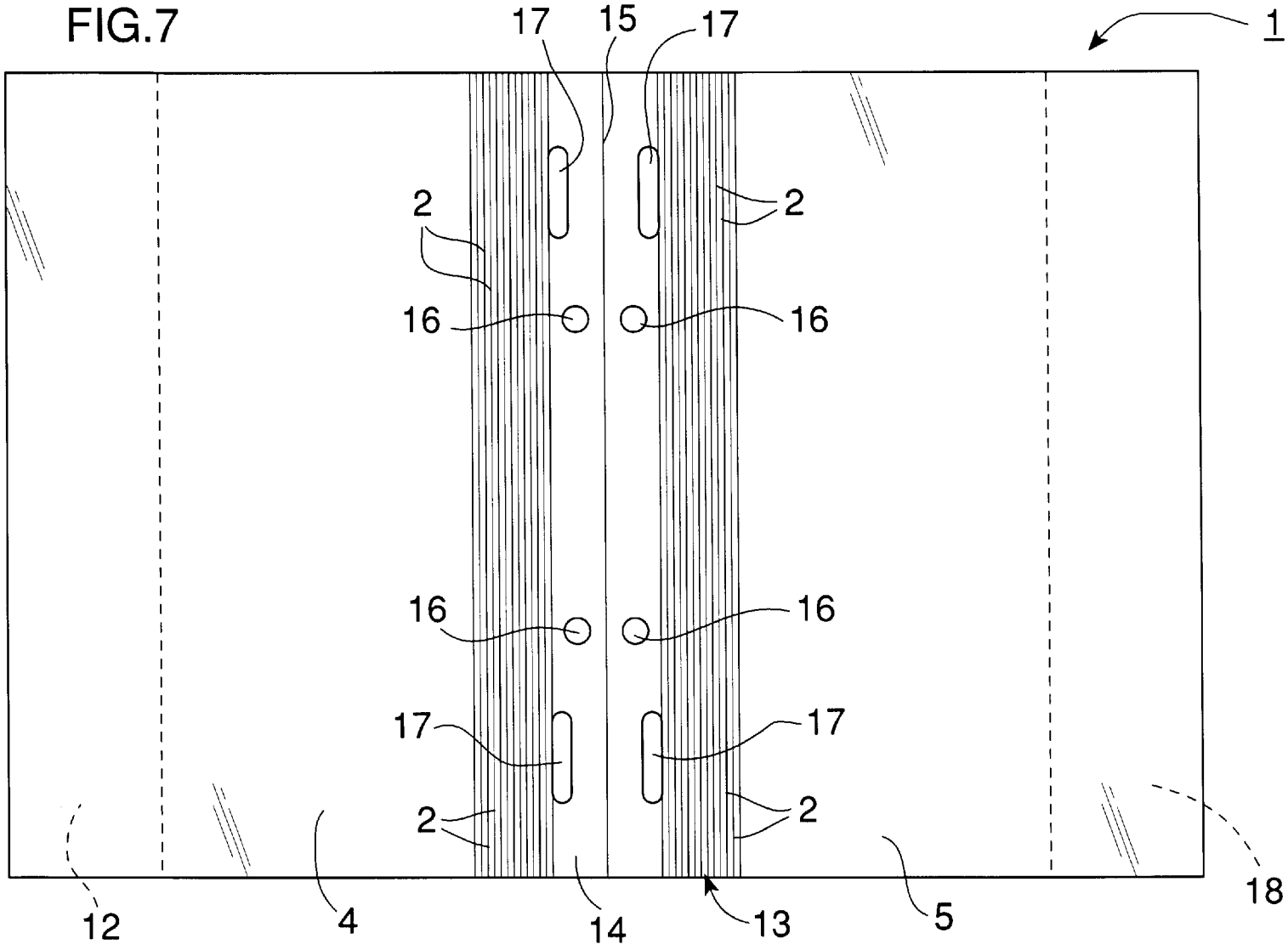
FIG. 7 is a plan view showing the third embodiment of the invention in a state in which the document cover is fully opened.
Figure 8:
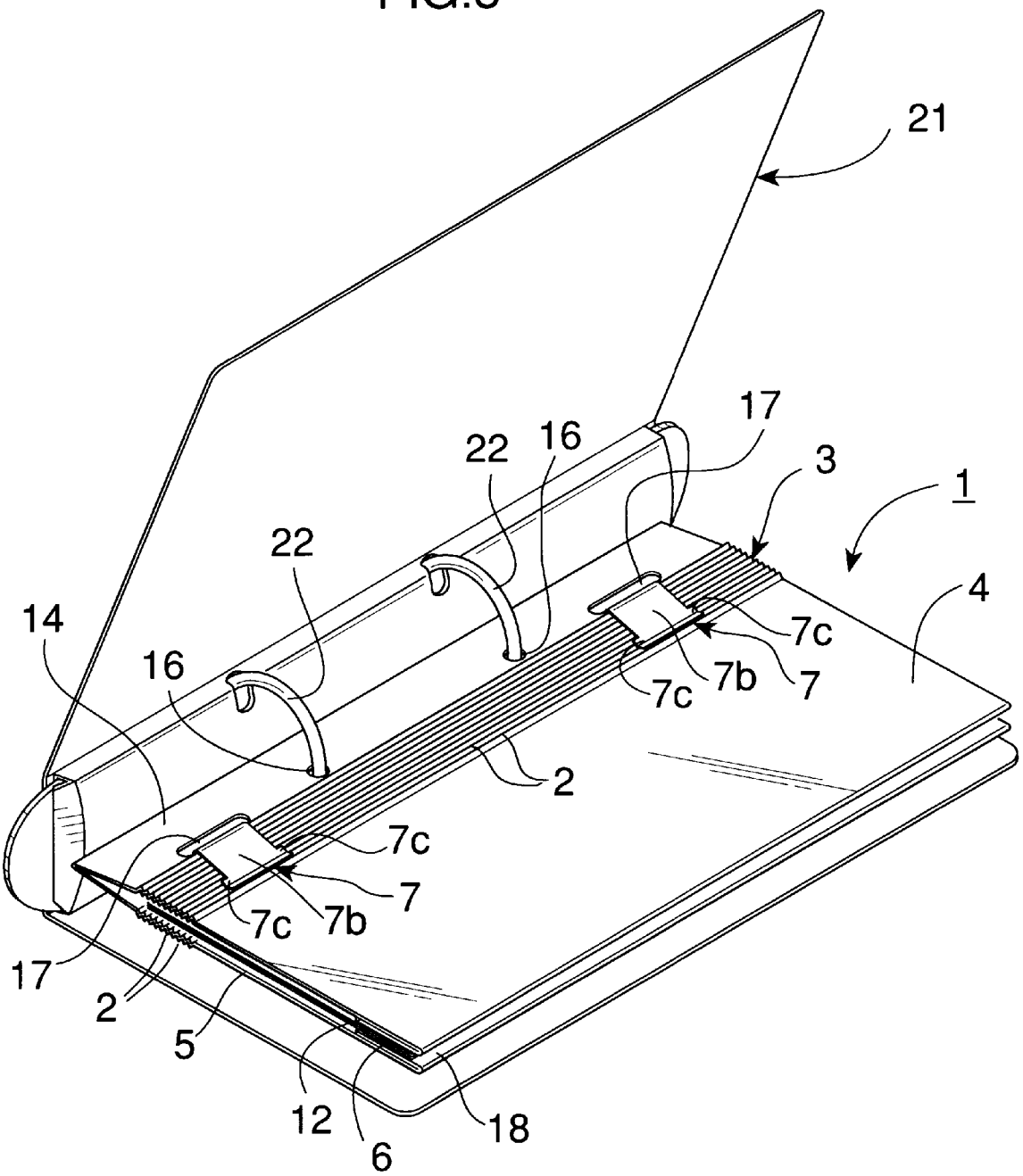
FIG. 8 is a perspective view for explaining the state where the document cover of the third embodiment is bound by a binder.

Referring next to FIGS. 6 through 8, a third embodiment of the invention will be described. In the third embodiment, as shown in detail in FIG. 7, the fold portion 13 is set to be wider than the fold portion 3 in the first and second embodiments. That is, a flat portion 14 having no fold line 2 is formed in the center portion of the fold portion 13. A trough fold line 15 is formed in the center portion of the flat portion 14. The third embodiment shows the case where the left side of the documents 6 is bound. Accordingly, the rear cover portion 5 in the first and second embodiments serves as a front cover portion 4 in this embodiment. Similarly, the front cover portion 4 in the first and second embodiments serves as a rear cover portion 5 in this embodiment. Further, four round holes 16 and four long holes 17 are formed in the flat portion 14 so that, when the flat portion 14 is folded at the trough fold line 15, these holes are aligned to form a pair of binder suspension holes to which binder pipes (which will be described later) are to be inserted respectively and a pair of clip holes to each of which an end of a clip driver not shown is to be inserted, that is, a clip 7 is to be inserted. Further, a cover flap portion 18 similar to the cover flap portion 12 in the front cover portion 4 is provided also on the rear cover portion 5.

To use the document cover 1, as shown in FIG. 6, the documents 6 are first put between the front cover portion 4 and the rear cover portion 5 so that the end edges of the documents 6 at the binding side on the left side do not enter the aligned long holes 17. Here, the end portion of a clip driver is inserted from one of the long holes 17 and actuated to press a clip 7 out of the clip driver while the front and rear cover portions 4 and 5 are put between the abutment portions 7*b* of the clip 7. Similarly to this, with respect to the other long hole 17, another clip 7 is pressed out of the clip driver. Thus, as shown in FIG. 6, the documents 6 are fastened between the front and rear cover portions 4 and 5 by means of the pair of clips 7.

The document cover 1 having the documents 6 bound in such a manner as described above may be bound in a binder 21 if two stop rings 22 of the binder 21 are inserted into the aligned round holes 16 as shown in FIG. 8. Also in the third embodiment, the cover flap portion 18 is formed on the rear cover portion 5, so that the rear surface or last page of the documents 6 may be put between the rear cover portion 5 and the cover flap portion 18.

If the documents 6 are covered with the document covers 1 separately under classification by themes or sections and fastened to the binder 21, the retrieval by themes or sections can be made easily and documents classified by themes or sections can be taken out easily.

Figure 9:
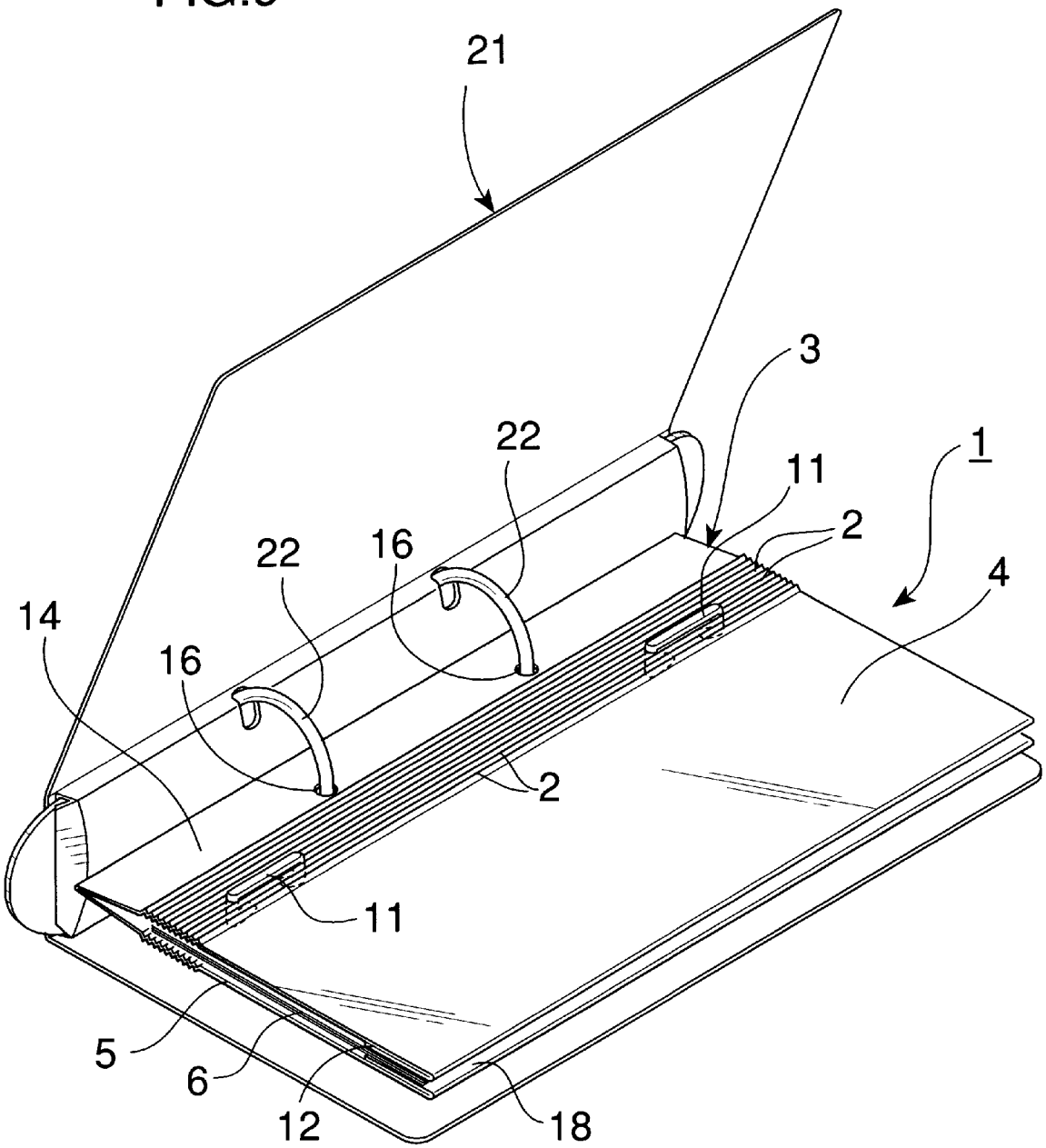
FIG. 9 is a perspective view for explaining the state where the document cover of a fourth embodiment of the present invention is bound by a binder.

A fourth embodiment shown in FIG. 9 shows an example where clipping is replaced by stapling. The fourth embodiment is substantially equivalent to the third embodiment except that the long holes 17 for the clips 7 are not required in the case of stapling.

Although the aforementioned first embodiment has shown the case where no cover flap portion is provided, it is a matter of course that a cover flap portion may be formed only on the front cover portion 4 or the cover flap portions may be provided both on the front and rear cover portions 4 and 5 respectively. Although the second, third and fourth embodiments have shown the case where the cover flap portion or portions are provided, such cover flap portion/portions need not be always provided.

It is a matter of course that the clips 7 in the first and third embodiments are not limited to the clips of the type shown in the drawings, and clips such as double clips which can be opened/closed by fingers may be used.

As is obvious from the above description, according to a first aspect of the present invention, a fold portion having a plurality of fold lines is provided in a boundary portion between front and rear cover portions. Accordingly, the cover can be folded and opened at any one of the fold lines located in the front cover portion, and even if the hold of the cover by hand is released after the cover is opened, the cover never returns.

According to a second aspect of the present invention, the plurality of fold lines in the fold portion include peak fold lines and trough fold lines formed alternately. In the case where documents to be bound are thick, a back portion can be formed over any two of the peak fold lines of the fold lines. Accordingly, the front cover portion or the rear cover portion never rises up.

According to a third aspect of the present invention, an end edge portion of the front cover portion opposite to the fold portion is folded inside to thereby form a cover flap portion. Accordingly, when the first page of the documents is put between the cover flap portion and the front cover portion, the first page of the documents is brought into close contact with the rear surface of the front cover portion. Accordingly, if the sheet material is a transparent or semi-transparent member, the first page of the documents can be read easily from the outside. In the case where a title is present on the first page of the documents, it is not necessary to write any title on the front cover portion.

According to a fourth aspect of the present invention, end edge portions of the front and rear cover portions opposite to the fold portion are folded inside to thereby form cover flap portions respectively. Accordingly, the first and last pages of the documents can be put between the front cover portion and its cover flap portion and between the rear cover portion and its cover flap portion, respectively. If the sheet material is a transparent or semitransparent member, the first page of the documents can be read easily from the outside. In the case where a title is present on the first page of the documents, it is not necessary to write any title on the front cover portion. In the case where the last page of the documents is an idle page, the last page may be put between the rear cover portion and the cover flap portion thereof.

According to a fifth aspect of the invention, the fold portion includes a flat portion located in its center portion so that the plurality of fold lines include a group of fold lines formed in a boundary portion between the flat portion and the front cover portion, another group of fold lines formed in a boundary portion between the flat portion and the rear cover portion, and a center fold line formed in a center portion of the flat portion, and holes in which document stopper members of a binder or loose-leaf binder are to be inserted are formed in the flat portion so that the holes formed in one part of the flat portion on the front cover portion side coincide with the holes formed in the other part of the flat portion on the rear cover portion side when the document cover is folded at the center fold line whereby the front cover portion and the rear cover portion come face to face each other and the one and the other parts of the flat portion come face to face each other.

According to a sixth aspect of the invention, clip holes in which clips for clipping outer surfaces of the front and rear cover portions are to be inserted are further formed so that the clip holes formed in the one part of the flat portion coincide with the clip holes formed in the other part of the flat portion when the document cover is folded at the center fold line whereby the one and the other parts of the flat portion come face to face each other.

What is claimed is:

1. A document cover formed of a thin sheet material of synthetic resin, comprising: a front cover portion, a rear cover portion, and a fold portion formed in a boundary portion between said front cover portion and said rear cover portion, said fold portion including a plurality of fold lines formed at intervals and having a plurality of peak fold lines and trough fold lines formed alternately.

2. A document cover according to claim 1, wherein an end edge portion of said front cover portion opposite to said fold portion is folded inside to thereby form a cover flap portion.

3. A document cover according to claim 1, wherein end edge portions of said front and rear cover portions opposite to said fold portion are folded inside to thereby form cover flap portions respectively.

4. A document cover formed of a thin sheet material of synthetic resin, comprising:

a front cover portion, a rear cover portion, and a fold portion formed in a boundary portion between said front cover portion and said rear cover portion, said fold portion including a plurality of fold lines formed at intervals; a flat portion located in a center portion of the fold portion so that said plurality of fold lines include one group of fold lines formed in a boundary portion between said flat portion and said front cover portion, and the other group of said fold lines formed in a boundary portion between said flat portion and said rear cover portion; a center fold line formed in a center portion of the flat portion; and holes formed in the flat portion to allow document stopper members of a binder to be inserted therein, said holes formed in one part of the flat portion on a side of the front cover portion aligning with the holes formed in the other part of the flat portion on a side of the rear cover portion when the document cover is folded at the center fold line so that the front cover portion and the rear cover portion face each other and said one and the other parts of the flat portion face each other.

5. A document cover according to claim 4, wherein clip holes in which clips for clipping outer surfaces of said front and rear cover portions are to be inserted are further formed so that the clip holes formed in said one part of said flat portion coincide with the clip holes formed in said other part of said flat portion when said document cover is folded at said center fold line whereby said one and the other parts of said flat portion are aligned to face each other.

6. A document cover according to claim 4, further comprising at least one cover flap portion formed in at least one of the front cover portion and the rear cover portion at an inside thereof.

* * * * *